US011524839B2

(12) United States Patent
Ptochos et al.

(10) Patent No.: US 11,524,839 B2
(45) Date of Patent: Dec. 13, 2022

(54) DOOR FOR SMART SHIPPING CONTAINERS

(71) Applicant: PEOPLE Technology Solutions, LTD., London (GB)

(72) Inventors: Dimitrios P. Ptochos, Messini (GR); Sotirios P. Ptochos, Messini (GR); Evangelos P. Ptochos, Messini (GR); Milan M. Sunaric, Nafpaktos (GR)

(73) Assignee: PEOPLE TECHNOLOGY SOLUTIONS, LTD., London (GB)

( * ) Notice: Subject to any disclaimer, the term of this patent is extended or adjusted under 35 U.S.C. 154(b) by 15 days.

(21) Appl. No.: 17/174,331

(22) Filed: Feb. 11, 2021

(65) Prior Publication Data

US 2021/0245951 A1 Aug. 12, 2021

(30) Foreign Application Priority Data

Feb. 11, 2020 (GR) ..... 20200100067

(51) Int. Cl.

| | |
|---|---|
| ***B65D 90/48*** | (2006.01) |
| ***B65D 90/00*** | (2006.01) |
| ***H01Q 1/42*** | (2006.01) |
| ***H01Q 23/00*** | (2006.01) |

(52) U.S. Cl.

CPC ..... *B65D 90/008* (2013.01); *B65D 90/48* (2013.01); *H01Q 1/42* (2013.01); *H01Q 23/00* (2013.01)

(58) Field of Classification Search

CPC ..... B65D 90/008; B65D 90/48; H01Q 1/42; H01Q 23/00

USPC ..... 343/720

See application file for complete search history.

(56) References Cited

U.S. PATENT DOCUMENTS

| | | | | |
|---|---|---|---|---|
| 7,333,015 | B2 | 2/2008 | Ekstrom | |
| 7,337,737 | B1 * | 3/2008 | Fanucci | B63B 25/24 114/75 |
| 8,797,160 | B1 | 8/2014 | Meyers | |
| 10,822,163 | B2 | 11/2020 | Ptochos et al. | |
| 2005/0212671 | A1 | 9/2005 | Auerbach et al. | |
| 2007/0193319 | A1 | 8/2007 | Huang et al. | |
| 2009/0174989 | A1 | 7/2009 | Nagel | |
| 2014/0225744 | A1 | 8/2014 | Claris | |
| 2018/0041944 | A1 * | 2/2018 | Korneluk | H04W 64/00 |
| 2019/0168959 | A1 * | 6/2019 | Ptochos | B65D 90/027 |
| 2020/0104785 | A1 * | 4/2020 | Ehrman | G01S 17/04 |

* cited by examiner

*Primary Examiner* — Peguy Jean Pierre

(74) *Attorney, Agent, or Firm* — CRGO Global; Steven M. Greenberg

(57) ABSTRACT

A door for a smart shipping container includes a door that has an outside skin strengthened by at least one hollow support beam defining an interior channel thereof. The door also includes embedded computing system disposed within the interior channel of the hollow support beam of the door. The embedded computing system includes a power source, memory, at least one processor, communications circuitry, an antenna and one or more sensors. Optionally, a window is defined in the hollow support beam so as to permit access by the antenna to an exterior of the door. For example, the window can be a three-sided window so as to permit access by the antenna to the exterior of the door irrespective of an opened or closed position of the door.

8 Claims, 2 Drawing Sheets

FIG. 1
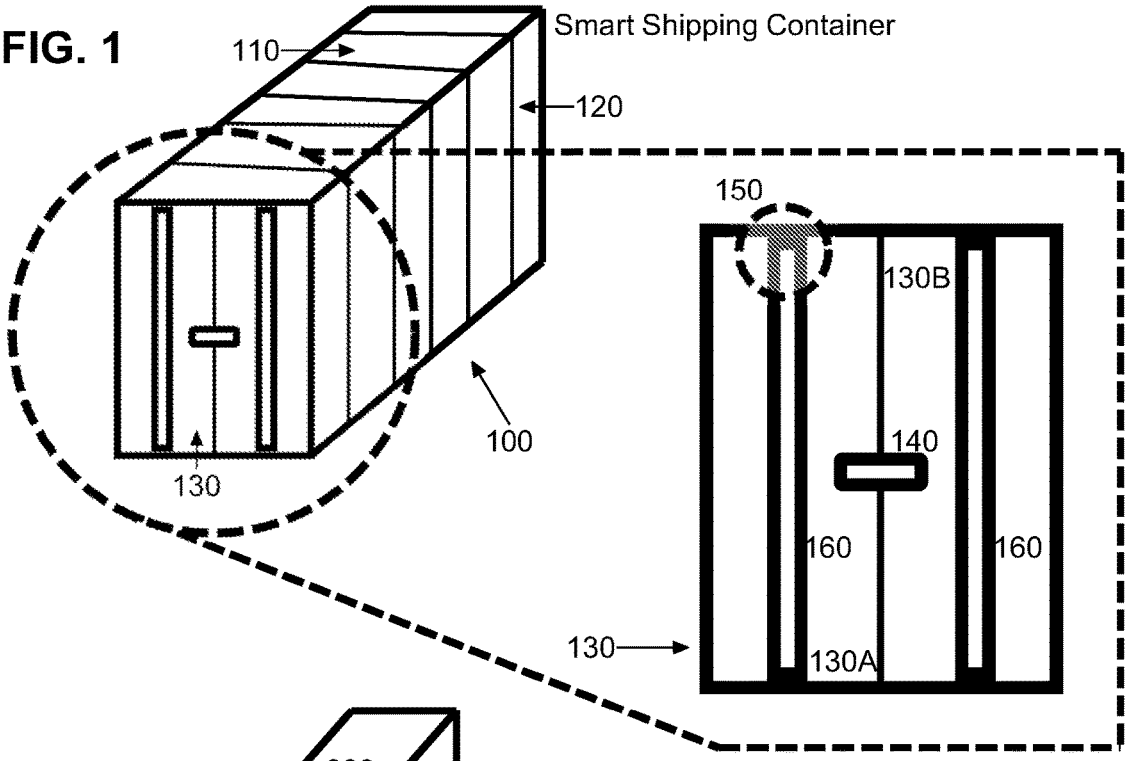
FIG. 2
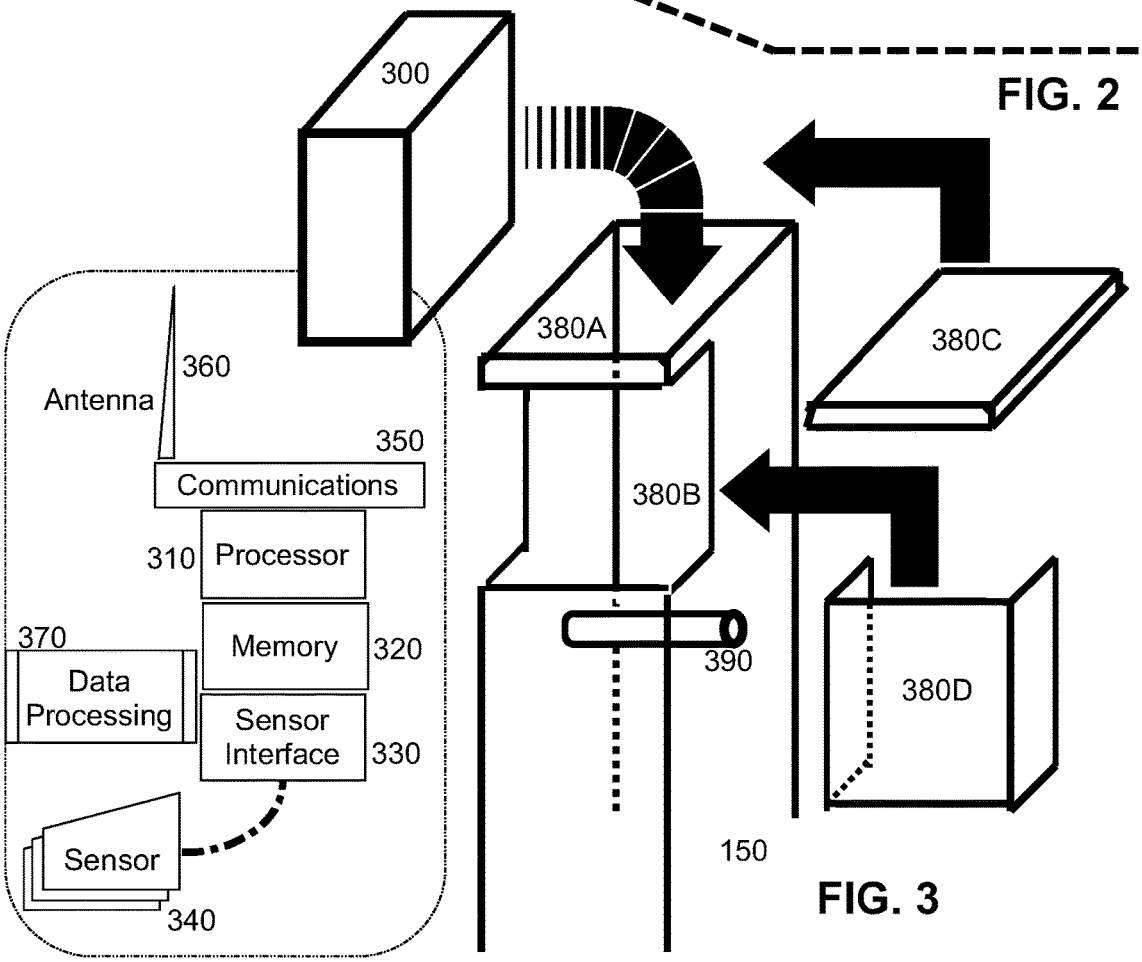
FIG. 3

DOOR FOR SMART SHIPPING CONTAINERS

BACKGROUND OF THE INVENTION

Field of the Invention

The present invention relates to the field of shipping containers and more particularly to smart shipping containers.

Description of the Related Art

Since first introduced nearly seven decades ago, standardized shipping containers have revolutionized cargo transport. A shipping container is a reusable transport and storage unit that serves to move products and materials between multiple locations. A typical container consists of a rectangular, closed box design with doors on one end, a corrugated weathering steel frame, and a wooden floor. Shipping containers are useful because of their ability to be easily transferred between rail, truck, and ship without having to be unloaded during the process. Shipping containers can be transported by truck on a trailer. When transported by rail, shipping containers are carried on flatcars or well cars. The containers can be easily stacked on top of one another, depending on particular rail system restrictions. Containers can also be transported by ship. Ships provide the highest capacity transport of any mode of transportation; some container ships can carry above twenty-thousand TEU. This high capacity can be achieved due to the large amount of area reserved for cargo aboard the ship and the stacking of containers on top of one another, typically up to seven units high. Ports and cargo terminals are generally configured to handle shipping container logistics using various handling equipment. Examples of such equipment include forklifts, gantry cranes, and reach stackers.

A shipping container consists of some key structural components that all transfer weight and racking forces. The first component is the roof. A shipping container roof is typically made of weathering steel sheets with corrugated profiles for strength and rigidity. The next component, the side wall panels, are made from the same material as the roof. Another component of a shipping container is the floor and cross members. A container floor is typically made of laminated marine plywood. The cross members are a series of transverse beams that provide for an integral part of the floor frame support. The floor frame may optionally include the gooseneck tunnel, which facilitates for the container's truck transport. The container floor rests on the cross members. An additional component is the top and bottom side rails. The side rails are longitudinal structure members located on the top and bottom of the container that act as a frame for the container's body. The top and bottom beams of the front end and the door end assemblies complete the frame of the container. The last key component includes the doors. The doors of a shipping container can be made of ply-metal, corrugated metal, or combinations with fiberglass. The doors are hinged and open at least one-hundred eighty degrees. Plastic or rubber lined door gaskets act as a seal against liquid entry.

A smart container is the next evolution in shipping containers. A smart container is instrumented with an embedded computing system comprising of sensors, processing units, memories and—wireless transceivers/communications circuitry that transmit sensed data to a remote backend system. The sensed data, which may include geolocation data, motion/acceleration data, environmental data can be processed by the backend system so as to provide to the end-user of the system an indication of the state of the container and to "address" detected problems, long before the container arrives at a location, where it may undergo visual inspection. In this regard, while a container may transport cargo from one location to a distant other location, the interested parties in the cargo, from government authorities, to cargo owners, to logistics companies, cannot control the integrity of the cargo because of a lack of information regarding the state of the container including whether or not the doors of the container have opened, whether or not moisture has encroached upon the content of the container, whether or not and the extent to which cargo has shifted position within the container, or whether a fire or chemical spill has occurred inside the container.

Instrumenting a shipping container helps to address this lack of information, but shipping container instrumentation is not without challenge. Obviously, the environment of a shipping container can be harsh and can include rain, snow, sleet, punishingly hot temperatures and freezing low temperatures, and of course, sea water. As well, a shipping container always is at risk of damage from unpredicted movement—especially when affixed to the deck of an ocean-going vessel. One solution is to place the computing components rendering the container "smart" inside the container. However, to do so inhibits communication between the computing components and the outside world owing to the thick metallic skin of the shipping container and the inability of the computing components to transmit a wireless signal through the thick metallic skin. Likewise, placing the computing components on the outside skin of the shipping container not only undesirably exposes the computing components to the elements, but also inhibits the close stacking of containers upon one another and the close placement of containers next to one another so as to optimize a number of containers able to fit on the deck of a vessel. Of course, placing the computing components on the outside skin of the container permits unwanted tampering with the computing component, either innocently or maliciously.

BRIEF SUMMARY OF THE INVENTION

Embodiments of the present invention address deficiencies of the art in respect to smart containers and provide a novel and non-obvious shipping container outfitted with a shipping container door with an integrated computing device. In an embodiment of the invention, a smart shipping container with a door integrated computing device includes a container that has two parallel elongated side walls each having a top rail at one side, each secured on an opposite side to a corresponding bottom rail of a floor frame, and each bottom rail coupled to one another by a floor secured to and resting on a multiplicity of cross-beam members of the floor frame. The container also includes a front-end assembly secured to one end of each of the top rails and to one end of each of the bottom rails over respective corner castings and a door end assembly opposite the front-end assembly and secured to an opposite end of each of the top rails and to an opposite end of each of the bottom side over respective corner castings.

The door end assembly includes at least one door that has an outside skin strengthened by at least one hollow support beam defining an interior channel thereof. Finally, the container includes a roof secured to respective ones of the top rails of each of the two side walls. Of note, an embedded computing system is disposed within the interior channel of the hollow support beam of the door. The embedded computing system includes one or more processing units, memories, sensors and wireless transceivers/communications circuitry, an antenna and a power source. In this way, the embedded computing system is not entirely contained within the inside chamber of the shipping container so as to inhibit wireless communications, and the embedded computing system is not disposed on an outside surface of the container subject to tampering including theft, and so as to prevent close stacking of the container relative to other containers. Hence, the embedded system is considered a part of the container and not a separate article subject to customs enforcement. But, of great importance, by placing the embedded computing system within the door of the container itself, the opening and closing of the door can be most closely sensed, monitored and recorded.

In one aspect of the embodiment, the sensors are embedded onto the embedded computing system inside the interior channel and operate through one or more openings on the interior channel. In another aspect of the embodiment, the sensors are disposed on the container outside of the interior channel. Alternatively, the sensors are disposed inside the container and outside of the interior channel. In either circumstance, the sensors sense at least one of temperature, humidity, moisture, attitude, and motion. As well, one of the sensors may be a door sensor indicating whether or not the door is opened or closed. Even further the sensors sense any of light, proximity, dust, carbon monoxide, carbon dioxide, weight, the presence of sound and the volume of present sound.

In another aspect of the embodiment, the container includes a pin horizontally traversing the interior channel below the embedded computing system and supporting the embedded computing system. In yet another aspect of the embodiment, a cap is welded to an opening of the hollow support. In even yet another aspect of the embodiment, a side window is defined in the hollow support at an overlapping level of the embedded computing system in the interior channel. Preferably, the side window is more than one-sided so that the antenna of the embedded computing system may access an exterior and interior of the container irrespective of an opened or closed position of the door. As well, a cap may be provided that covers the side window. For example, the cap may be formed from a non-metallic material and can be painted with a same color as the door or container so as to cause the existence of the cap to be obscured and not readily apparent to the eye.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is perspective view of a smart shipping container configured with a door integrated computing device;

FIG. 2 is a schematic illustration of the door assembly of the smart shipping container of FIG. 1, including one or more doors instrumented with an integrated computing device;

FIG. 3 is an exploded view of a portion of a beam of one of the doors of FIG. 2; and, FIG. 4 is a flow chart illustrating a process for assembling a shipping container door with an integrated computing device.

DETAILED DESCRIPTION OF THE INVENTION

Figure 4:
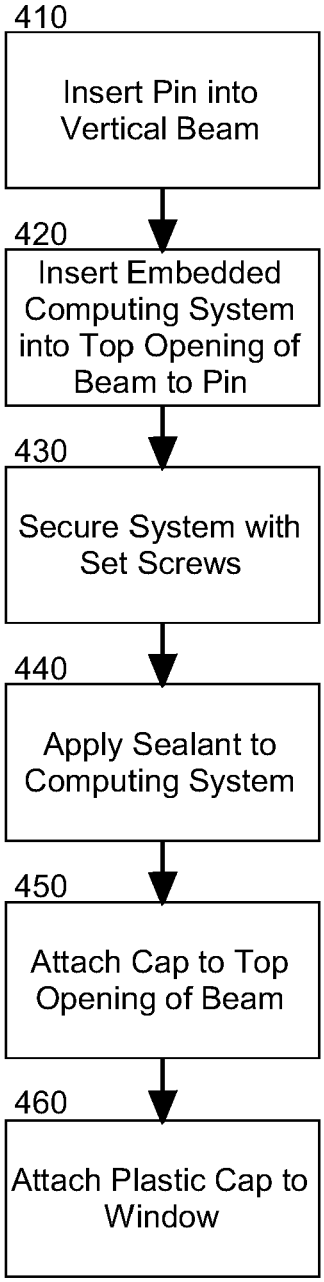

Embodiments of the invention provide for a smart shipping container incorporating a door integrated computing device. The container includes a door assembly with one or more doors. The doors are supported by one or more hollow beams. An embedded computing system is disposed within a hollow space defined within the hollow beam and coupled to one or more sensors, which may be embedded onto the embedded computing system. The embedded computing system is secured within the hollow space from an open portion of the beam resting on a pin traversing the hollow space below the embedded computing system. Optionally, a window is defined on an outside surface of the beam at a level commensurate with the embedded computing when the embedded computing system rests on the pin.

The window may be three-sided to ensure access by an antenna of the computing system to an exterior of the door in order to facilitate wireless communications with a remote receiver. In this regard, when the door is closed, at least one side of the window will be open to an external portion of the container to facilitate communications and at least one side of the window will be open to an internal portion of the container to facilitate communication with any sensors or devices included inside the container. As well, when the door is open, all three sides of the window will be open to an external portion of the container so as to enhance wireless communications with the remote receiver. A non-metallic cap then is secured to the window covering the window. For example, the cap can be made of a plastic material. In this way, the container can be rendered a smart container without inhibiting the wireless communications of the embedded computing system and without inhibiting the close positioning of the container with other containers, while limiting an ability of an actor to tamper with the embedded computing system.

In further illustration, FIG. 1 provides perspective view of a smart shipping container with a door integrated computing device. As shown in FIG. 1, a smart shipping container 100 includes two parallel elongated corrugated side walls 120 each having a top rail at one side, each secured on an opposite side to a corresponding bottom rail of a floor frame, and each bottom rail coupled to one another by a floor secured to and resting on a multiplicity of cross-beam members of the floor frame. The container 100 also includes a front-end assembly (not shown) secured to one end of each of the top rails and to one end of each of the bottom rails over respective corner castings and a door end assembly 130 opposite the front-end assembly and secured to an opposite end of each of the top rails and to an opposite end of each of the bottom side over respective corner castings. Finally, the container 100 includes a roof 110 secured to respective ones of the top rails of each of the two side walls 120.

In further illustration of the structure of the door assembly 130, FIG. 2 is a schematic illustration of the door assembly 130 of the smart shipping container 100 of FIG. 1, instrumented with an integrated computing device. The door end assembly 130 includes at least one door 130A, 130B that has an outside skin strengthened by at least one hollow support beam 160 defining an interior channel thereof. The doors 130A, 130B may be secured in a closed position according to latch 140. Of note, an embedded computing system may be disposed anywhere within the hollow space of any of the hollow support beams. For example, it may be disposed at a position 150 within the interior channel of one of the hollow support beams 160 of a corresponding one of the doors 130A, 130B.

In yet further illustration of the integration of an embedded computing system at the example position 150 within the interior channel of the one of the hollow support beams 160, FIG. 3 is an exploded view of the position 150 of FIG. 2. As shown in FIG. 3, the portion 150 is at a top end of the one of the hollow support beams 160 and includes an opening 380A at the top end. The portion includes a window 380B defining a side opening in the portion 150 through which the hollow area defined within the portion 150 may be accessed. A pin 390 traverses the hollow area below a level of the service window 380B. As can be seen, the window 380B can be three-sided to permit access by an antenna 360 of an inserted embedded computing system 300 to an exterior portion of the one of the hollow support beams 160.

The embedded computing system 300 then is inserted through the opening 380A and rests on the pin 390. The embedded computing system 300 includes at least one processor 310, memory 320, sensors 340, a power source such as a battery (not shown) and wireless transceivers/communication tranceivers 350 including the antenna 360. One or more of the sensors 340 can be disposed on the container outside of the hollow area. Alternatively, one or more of the sensors 340 can be disposed inside the container and outside of the hollow area. Each of the sensors 340 senses at least one of temperature, humidity, moisture, attitude, and motion. Further, the sensors 340 can sense light, proximity, dust, carbon monoxide, carbon dioxide, weight, pressure, the presence of sound and the volume of present sound.

Finally, at least one of the sensors 340 may be a door sensor indicating whether or not the door is opened or closed. In this regard, at least one of the sensors 340 may include an arrangement of four sensor components: a light sensor monitoring levels of light intensity so as to correlate increasing light intensity with an opening of the corresponding one of the doors 130A, 130B, a magnetic proximity sensor sensing a change in distance between the corresponding one of the doors 130A, 130B and a magnet placed upon an adjacent one of the doors 130A, 130B, or on a fixed portion of the container 100, an accelerometer measuring movement of a corresponding one of the doors 130A, 130B such that if the known starting position of the corresponding one of the doors 130A, 130B is closed, the observation of the accelerometer of a swinging movement of the corresponding one of the doors 130A, 130B may be interpreted as an opening of the corresponding one of the doors 130A, 130B, and a temperature/humidity sensor adapted to sense a threshold change in the temperature and humidity indicating an opening or closing of the corresponding one of the doors 130A, 130B. These four components can combine to provide an accurate indication of an opening or closing of the corresponding one of the doors 130A, 130B is open.

A data processing computer program 370 executes in the memory 320 of the embedded computing system 300 by the processor 310. The data processing computer program 370 processes data received in the sensor interface 330 from the one or more sensors 340. The received data may then be transmitted through antenna 360 by communications circuitry 350 to a remote server present on a vessel transporting the container, or a land based remote server, through wireless communications such as cellular data communications.

Once the embedded computing system 300 has been inserted into the hollow space of the example portion 150, the embedded computing system 300 is secured within the hollow space using sealant and, optionally, by one or more set screws penetrating the outer surface of the portion onto an outer surface of the embedded computing system. Then, a cap 380C is secured to the top end 380A and a plastic cover 380D is secured to the window 380B.

In even further illustration of the example process of securing the embedded computing system 300 within the portion 150 FIG. 4 is a flow chart illustrating a process for assembling a shipping container door with an integrated computing device. Beginning in block 410, a pin is inserted into the beam of the door so as to traverse an interior channel defined within the beam. The pin is then secured to the beam by way of glue or welding. In block 420, the embedded computing system is inserted into the channel from an open, in this example top portion of the beam and rests on the pin. In block 430, one or more set screws are applied to an outside of the beam through a threaded portion of the beam and onto an outer surface of the embedded computing system, and optionally into a threaded hole of the embedded computing system. In block 440, the embedded computing system is then secured within the channel by way of a sealant such as a glue. In block 450, a top cap is then secured to the top portion by way of glue or welding. Finally, in block 460, a plastic cap is affixed to the window of the beam.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A smart shipping container with a door integrated computing device, comprising:

two parallel elongated side walls each having a top rail at one side and each being secured on an opposite side to a corresponding bottom rail of a floor frame, each bottom rail being coupled to one another by a floor secured to and resting on a multiplicity of cross-beam members of the floor frame;

a front-end assembly secured to one end of each of the top rails and to one end of each of the bottom rails over respective corner castings;

a door end assembly opposite the front end assembly and secured to an opposite end of each of the top rails and to an opposite end of each of the bottom side over respective corner castings, the door end assembly comprising at least one door, the dooring comprising an outside skin strengthened by at least one hollow support beam defining an interior channel thereof;

a roof secured to respective ones of the top rails of each of the two side walls;

an embedded computing system disposed within the interior channel of the at least one hollow support beam of the at least one door, the embedded computing system comprising a power source, memory, at least one processor, communications circuitry, an antenna and one or more sensors; and, a window defined in the hollow support beam at an overlapping level of the embedded computing system in the interior channel.

2. The container of claim 1, further comprising a cap welded to an end opening of the hollow support beam.

3. The container of claim 1, wherein the window is a more than one-sided window so that the antenna is exposed by at least one side of the window irrespective of an open or closed position of the door.

4. The container of claim 3, further comprising a non-metallic cap covering the window.

5. A door adapted for inclusion in a smart shipping container, the door comprising:

at least one hollow support beam, defining an interior channel thereof;

an outside skin strengthened by the at least one hollow support beam; and, an embedded computing system disposed within the interior channel of one of the hollow support beams, the embedded computing system comprising a power source, memory, at least one processor, communications circuitry, an antenna and one or more sensors; and, a window defined in the hollow support beam at an overlapping level of the embedded computing system in the interior channel.

6. The door of claim 5, further comprising a cap welded to an end opening of the hollow support beam.

7. The door of claim 5, wherein the window is a more than one-sided window so that the antenna is exposed by at least one side of the window irrespective of an open or closed position of the door.

8. The door of claim 5, further comprising a non-metallic cap covering the window.

* * * * *